United States Patent [19]

Delia

[11] Patent Number: 4,516,683

[45] Date of Patent: May 14, 1985

[54] CHILD-RESISTANT CLOSURE

[75] Inventor: Anthony Delia, West Redding, Conn.

[73] Assignee: The Drackett Company, Cincinnati, Ohio

[21] Appl. No.: 602,880

[22] Filed: Apr. 23, 1984

[51] Int. Cl.[3] ..... B65D 55/02; B65D 85/56; A61J 1/00

[52] U.S. Cl. ..... 215/211; 215/206; 220/260; 220/307

[58] Field of Search ..... 220/260, 366, 281, 307; 215/211, 224, 206

[56] References Cited

U.S. PATENT DOCUMENTS

| | | | |
|---|---|---|---|
| 165,962 | 7/1875 | Stevens et al. . | |
| 3,393,818 | 7/1968 | McIntosh | 220/260 |
| 3,669,295 | 6/1972 | Horvath | 215/206 |
| 3,759,411 | 9/1973 | Horvath . | |
| 3,966,082 | 6/1976 | Hopkins | 220/306 |
| 4,043,474 | 8/1977 | McCord | 215/211 |
| 4,315,578 | 2/1982 | Ludwig, Jr. | 220/366 |
| 4,401,225 | 8/1983 | Schwaikert | 215/211 |
| 4,413,748 | 11/1983 | Kessler et al. | 220/307 |

*Primary Examiner*—George T. Hall
*Attorney, Agent, or Firm*—Charles J. Zeller

[57] ABSTRACT

A child-resistant closure comprising a can ring provided with an orifice through which the container is filled or emptied, the orifice having a peripheral rim in the form of an inverted U-shaped channel defined by an exterior leg and an interior leg, a portion of the interior leg extending below the lower edge of said interior leg to provide an unlocking tab, said can ring being further provided with indicia in its top surface to designate the location of said unlocking tab, and a cap, the cap comprising a disc portion; an annular ring portion disposed in a plane parallel to said disc portion, said annular ring portion having a peripheral sealing skirt; an annular wall connecting the disc portion and the annular ring portion, the annular wall forming with the sealing skirt an arcuate annular groove on the underside of the annular ring portion, the annular groove being adapted for flush superposition on the inverted U-shaped channel; a pull tab extending outwardly horizontally from the periphery of the annular ring portion; an annular retaining flange extending through the periphery of the disc portion; and a first protrusion extending outwardly horizontally from said annular retaining flange, the protrusion being proximate to and in alignment with the pull tab.

28 Claims, 12 Drawing Figures

Fig. 1.
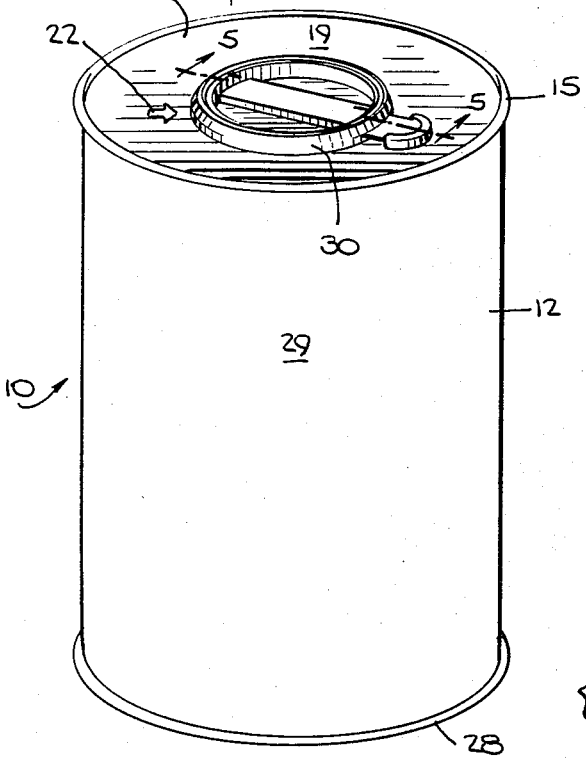
Fig. 2B.
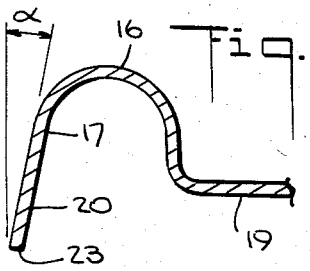
Fig. 2D.
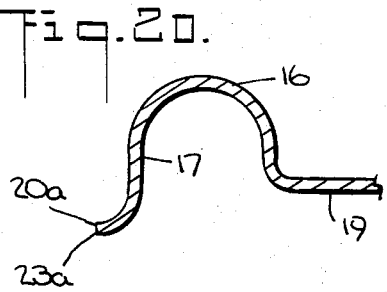
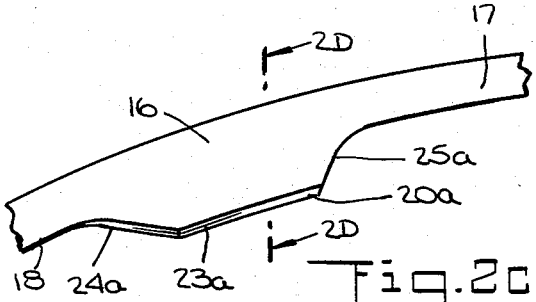
Fig. 2C.
Fig. 2.
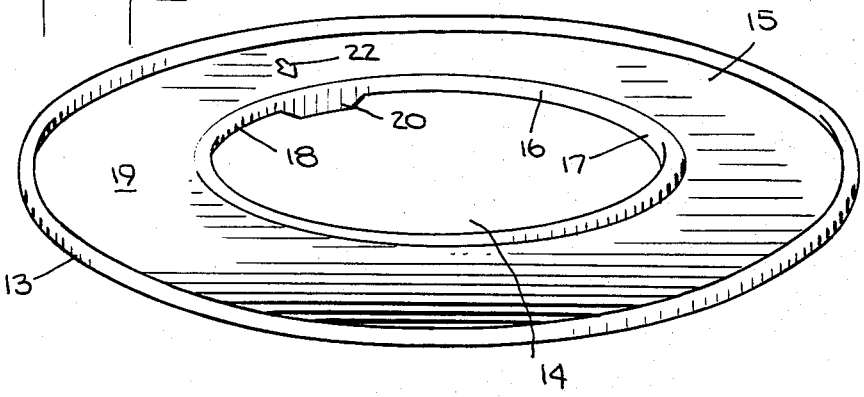
Fig. 2A.
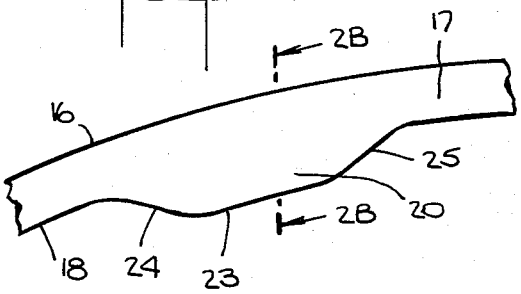
Fig. 2E.
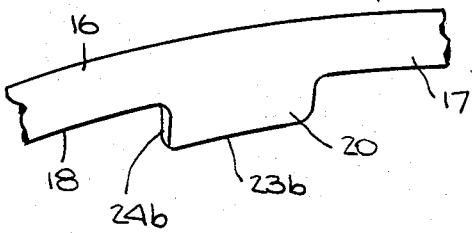

CHILD-RESISTANT CLOSURE

DESCRIPTION

1. Field of the Invention

This invention relates to safety closures adopted for sealing containers having an essentially planar top surface, which top surface has a large diameter orifice through which the container may be filled or emptied. More specifically, the present invention relates to such a container wherein the closure cap therefor is removable by an upward pull force when the pull tab is brought into alignment with an unlocking tab release means. Most specifically, the present invention relates to such a container wherein the closure cap, when oriented for removal, requires only a moderate force to disengage the cap from the container, but requires substantial force for removal when the cap is not so oriented.

2. Background of the Invention

U.S. Pat. No. 4,315,578 to Ludwig, Jr., commonly assigned to the assignee herein, discloses a safety closure cap having a vent adapted to relieve pressure within the container caused by gas accumulation, the vent feature of the '578 cap not being pertinent herein. The cap disclosed in '578 patent, with or without the vent, can be used in accordance with the present invention.

As shown in the '578 patent at FIG. 6 and disclosed at column 4, line 52 bridging to column 5, line 11, the cap of the '578 patent is disengaged by depressing the center portion of the cap with one's thumb, and with the other hand exerting an upward force on the pull tab. Removal of the cap cannot be accomplished unless the center portion of the cap is depressed. Engagement and disengagement of the cap can be made in any orientation.

U.S. Pat. No. 4,401,225 to Schwaikert discloses a child-resistant closure unit which, except for the vent means, is substantially the same as that disclosed and taught in the '578 patent. Thus, the '225 cap is similarly removed by simultaneous depression of the cap and the pulling of a tab connected to the top rim of the cap. Again, no specific orientation is required to engage or disengage the cap.

U.S. Pat. No. 4,043,474 to McCord discloses a child resistant closure wherein the top surface of the container, generally referred to as a can ring in the art, is provided with a large diameter orifice. In the '474 patent, the rim of the orifice, element 20 in FIG. 4, is provided with at least one, preferably two opposed, arcuate recesses 22, 24, while the cap 30 is provided with peripheral arcuate lugs 42, 44 corresponding to said recesses, the radii of the lugs being slightly greater than that of the recesses. When aligned, an upward force on the pull tab effects removal.

U.S. Pat. No. 3,759,411 to Horvath discloses first cam means in the form of an arcuate wedge positioned on the exterior surface of a raised flange on the container body cooperating with second cam means on the interior surface of the cover side wall so as to deflect a portion of the cover away from the container body. U.S. Pat. No. 4,051,794 to Gentile and U.S. Pat. No. 165,962 to Stevens, et al., are of interest.

SUMMARY OF THE INVENTION

It is an object of the present invention to provide a container in combination with a closure cap therefor, which container has a planar top surface that is a can ring provided with a large diameter orifice and whose closure cap in cooperation with said can ring, provides a child resistant closure.

It is a further object of the present invention to provide a child resistant closure such that the cap is removable from the can ring when the pull tab of said cap is brought into alignment with an unlocking tab release means provided in the can ring, by a pull force on the pull tab, and without the requirement to depress the center portion of the cap.

It is another object of the present invention to provide a container of the type described wherein the cap is more amenable to disengagement by arthritics and the elderly, but which retains functionality as a child resistant closure.

It is also an object of the present invention to provide a can ring having means adapted to facilitate the disengagement of the cap when said cap is properly positioned there within.

These and other advantages and benefits of the present invention will be perceived upon review of the accompanying drawings and on a complete reading of the specifications, a summary of which follows.

The closure of the present invention comprises a can ring having a planar surface, an orifice being provided therein, which orifice has a downwardly extending peripheral flange, a minor portion of said flange extending below the lower edge of the major portion thereof, the minor portion being an unlocking tab, the can ring further having indicia on said planar surface to designate the location of the unlocking tab, and a cap adapted for snap fit retention within said can ring orifice.

The cap preferably comprises a disc portion; an annular ring portion disposed in a plane parallel to said disc portion, said annular ring portion having a peripheral shirt, an annular wall connecting said disc and said annular ring portions; a pull tab extending outwardly horizontally from the periphery of the annular ring portion; an annular retaining flange extending through the periphery of said disc portion; and a first protrusion extending outwardly horizontally from said annular retaining flange, which protrusion is proximate to and in alignment with the pull tab.

In the preferred embodiment of the invention, the can ring orifice has a peripheral rim in the form of an inverted U-shaped channel defined by an exterior leg and an interior leg, the interior leg being said downwardly extending flange. With this construction of the can ring, the cap is provided with an annular groove formed between said sealing skirt and said annular wall, on the underside of the annular ring portion, said annular groove adapted for flush superposition on said inverted U-shaped channel

BRIEF DESCRIPTION OF THE DRAWINGS

FIG. 1 is a perspective view of a container featuring the container closure of the present invention, in locked position.

FIG. 2 is a perspective view of the can ring of the present invention, showing the unlocking tab.

FIG. 2A is an enlarged view of the unlocking tab shown in FIG. 2. FIG. 2B is a cross sectional view of the unlocking tab shown in FIG. 2 across lines 2B—2B of FIG. 2A.

FIGS. 2C and 2D show an alternate embodiment of the unlocking tab shown in FIG. 2.

FIG. 2E shows another embodiment of the unlocking tab.

DETAILED DESCRIPTION OF THE PREFERRED EMBODIMENT

Figure 3:
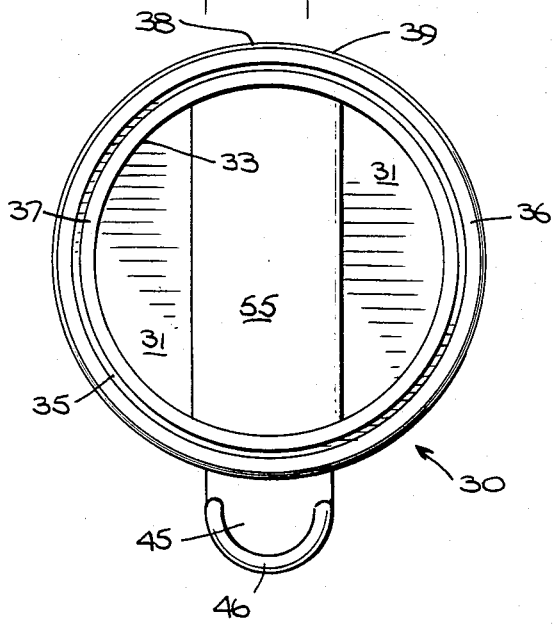
FIG. 3 is a top view of the cap preferred for use in the closure of the present invention.

FIG. 1 is a perspective view of a container 10 provided with a closure of the present invention, the container 10 comprising a container body 12 having as the top surface a first can ring 13, as the bottom surface a second can ring 28, and cylindrical side wall surface 29 between said can rings, and a cap 30. The closure of the present invention comprises the can ring 13 and the cap 30.

As shown in FIG. 2, the can ring 13 is a planar disk having a centrally positioned large diameter orifice 14. The can ring 13 is provided with a peripheral rim 15 which forms a raised inverted U-shaped channel into which the side wall 29 is secured, and an interior rim 16 that forms a raised inverted U-shaped channel about the periphery of the orifice 14, the interior leg 17 of the rim 16 having a sharp peripheral edge 18. An annular surface 19 is formed between the rims 15 and 16. A portion of the leg 17, which portion is referred to as the unlocking tab 20, is shown to extend below the edge 18. Indicia 22 is provided on surface 19 to indicate the location of the unlocking tab 20.

Referring to FIGS. 2A and 2B, the unlocking tab 20 has a linear central portion 23, arcuate segments 24 and 25 connecting the central portion 23 with the interior leg 17 of the rim 16. Preferably, as shown in FIG. 2B, the tab 20 is canted inwardly toward the center of the orifice at an angle $\alpha$, said angle being from about 3° to about 10°. Too high an angle $\alpha$, greater than about 12°, is undesirable because the cap is then too easily removable. Preferably, the chordal length of the unlocking tab describes an arc of about 15° to about 25°, most preferably from about 18° to about 22°. FIGS. 2C and 2D illustrate an alternate embodiment of the unlocking tab, here designated as tab **20*a*, wherein the tab flairs radially inwardly towards the center of the orifice 14 from the interior leg 17 of the rim 16. In the alternate embodiment shown in FIG. 2E, the tab 20*b*, as compared to tab 20, is more rectangular in configuration, the connecting segments 24*b* and 25*b*** being essentially linear.

Figure 4:
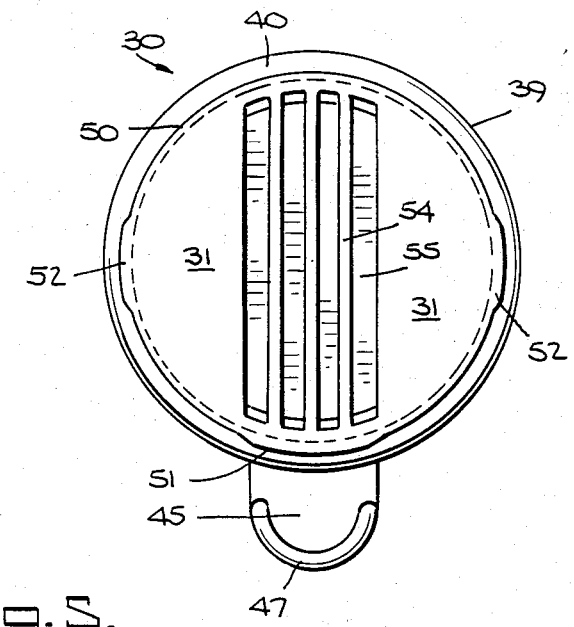
FIG. 4 is a bottom view of the cap.
Figure 5:
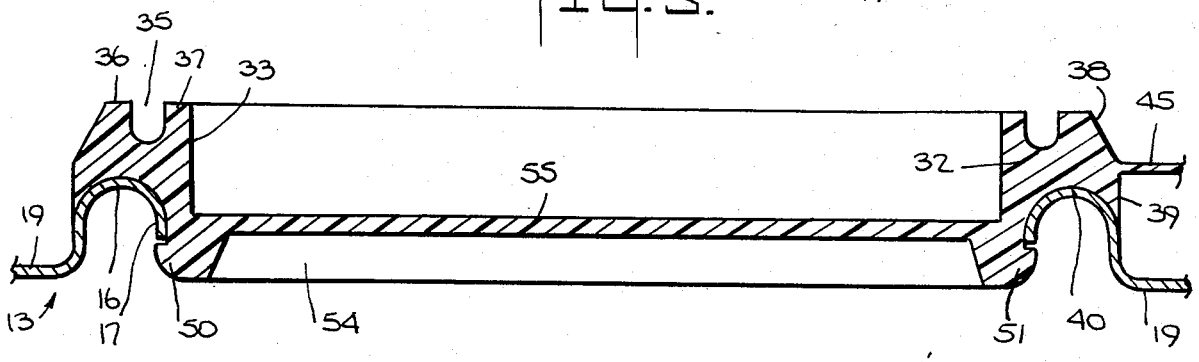
FIG. 5 is a cross-sectional view across lines 5—5 of FIG. 1.

FIGS. 3 and 4 are, respectively, top and bottom views of the closure cap 30. FIG. 5 is a sectional view taken along line 5—5 of FIG. 1 and shows the cap 30 within the orifice 14 in locked position, that is, with the pull tab not in alignment with the indicia 22.

Referring to FIGS. 3, 4 and 5, the cap 30 is seen to be unitary in construction and can be made by conventional molding techniques. It is made from a resilient material such as a synthetic resin, preferably a low density polyethylene or a polyester elastomer, or natural rubber, the material being sufficiently tough to minimize wear due to engagement and disengagement. The cap 30 has a disc portion 31 and an annular ring portion 32 disposed in a plane parallel to said disc portion 31, the disc portion 31 and the annular ring portion 32 being connected by annular wall 33. The annular ring portion 32, as best seen in FIGS. 3 and 5, has a U-shaped annular recess 35 in its upper surface formed between the outer annulus 36 and the inner annulus 37. The outer annulus 36 of the annular ring portion 32 has a beveled surface 38 leading to an essentially vertical surface 39, the vertical surface 39 being a sealing skirt and forming with the short annular wall 33 an arcuate annular groove 40 on the underside of the annular ring portion 32.

As best seen in FIGS. 3 and 4, a pull tab 45 extends outwardly horizontally from the periphery of the annular ring portion 32, and preferably is provided with upper gripping means 46 and lower gripping means 47, which gripping means can be crescent shaped protrusions about 1/20 of an inch in height.

As best seen in FIGS. 4 and 5, the disc portion is provided with a peripheral annular retaining flange 50 from which at least one protrusion, the primary protrusion 51, extends. The protrusion 51 is positioned at a point on the retaining flange 50 that is directly below the pull tab 45. Secondary protrusions 52 may be optionally provided at points on the annular retaining flange 50 which are approximately at 90° angles to the primary protrusion 51. A series of stiffener ribs 54 are provided across the diameter of the disc portion 31, the orientation of the ribs 54 being such that they are in parallel alignment with the pull tab 45. The ribs 54 are joined at their uppermost points by a planar member 55.

To remove the cap 30 from the container 10, the cap is rotated to a position of alignment of the indicia 22 and the pull tab 45, and, hence, alignment of the primary protrusion 51 and the unlocking tab 20. A turning force of from about 2 to 8 inch pounds is suitable for rotating the cap into alignment position. Preferably, this force is from 2 to 5 inch pounds. In the aligned position a vertical pull force of from about 2 to 8, preferably from 2 to 5, pounds is necessary to effect removal. These forces are predetermined by the dimensions and tolerances set in the manufacture of the closure, which are within the scope of one skilled in the art to establish.

Figure 6A:
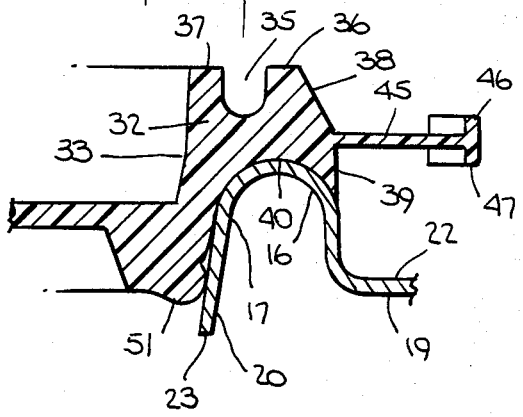
FIG. 6A is a cross section view of a portion of the cap and the can ring, the pull tab of the cap being in alignment with indicia on the can ring surface and in position for removal.

Referring to FIG. 6A, the primary protrusion 51 is in alignment with indicia 22, and hence with unlocking tab 20. As a consequence of the alignment the primary protrusion 51, owing to its resilient nature, has been displaced from its previous position beneath the edge 18 of the interior rim 16. As shown in FIG. 6A, the protrusion 51 has been deflected downwardly relative to the disc portion 31, and has also been inwardly compressed toward the center of the disc portion 31. Although the protrusion 51 is not actively locking the cap 30 within the orifice 14, the cap is retained positively within the orifice in view of the secondary protrusions that may be provided, and further in view of the force applied by the compressed primary protrusion 51 against the unlocking tab 20. In addition, the superposition of the arcuate groove 40 on the interior rim 16 is a close fit that provides additional resistance to removal.

Figure 6B:
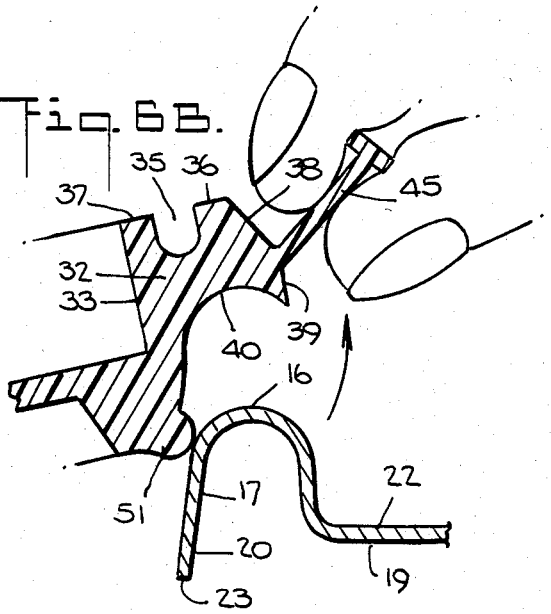
FIG. 6B is a cross section of a portion of the cap and the can ring, the cap being shown in a position intermediate its complete removal from the can ring.

As shown in FIG. 6B, a pull force applied to the tab 45, preferably in torquing manner (here counterclockwise as shown by the arrow), lifts the arcuate groove portion 40 away from the rim, while the primary protrusion 51 is guided upwardly along the unlocking tab 20 and interior leg 17. In view of the canting of the tab 20, the force to remove the cap 30 from the interior rim gradually decreases as the cap is withdrawn.

Under standards of the Consumer Product Safety Commission (CPSC), 16 C.F.R. 1700.1 et seq., closure caps for many household products are required to meet both adult and child protocols. Thus, for example, 16 C.F.R. 1700.20 states that for "special packaging", 200 children between 42 and 51 months evenly distributed by age and sex are to be tested. Each child is first allowed 5 minutes to open the packaging. For those who are unable to do so, a visual demonstration is given, followed by a second 5 minute opportunity to open the packaging. A test is passed if the child resistant effectiveness, defined as the number of tested children less the number of failures, divided by two, is not less than 85% without demonstration and not less than 80% with demonstration.

Similarly, 100 adults between 18 and 45 years, 70% of whom are women, comprise the adult test panel, and are individually tested. Each adult receives printed instructions on opening and closing the closure. Five minutes are allowed for the test. Not less than 90% of the adults must pass this test.

No standards are set for arthritic or elderly users of the containers.

Tests were conducted pursuant to the CPSC regulations for the closure of the present invention, the standards set by the regulations being met in both instances. Tests were also conducted among arthritic individuals comparing the prior art closure disclosed in U.S. Pat. No. 4,315,578 to Ludwig, Jr. and the closure of the present invention, which tests are not mandated by CPSC regulations. It was found that among the 107 arthritics tested, 93% opened the closure of the present invention, while only 49% opened the prior art closure. In the case of the prior art closure, placement in any orientation is considered a proper closing. With the closure of the present invention, reclosure is considered proper only if the unlocking tab and pull tab are not in alignment, such alignment being the orientation for removal. Of those arthritics who successfully removed the cap from the closure of the present invention, 27% did not properly reclose the container. For the closure of the present invention, 68% of the arthritic individuals tested both opened and properly closed the container, as compared to 49% for the prior art closure, which difference is statistically significant at a 95% confidence level. Arthritics participating in the test indicated a substantial preference for the closure of the present invention as compared to the prior art closure.

For a container provided with a $1\frac{1}{2}$ inch diameter cap 30, the height of the interior rim 16 can be about $\frac{1}{8}$ inch. The angle $\alpha$ is preferably about 8° and the interior leg 17 has a height of about 3/32 inch. For a tab 20 of the type shown in FIG. 2A, the arcuate surfaces 24,25 can have a radial dimension from the edge 18 of about $\frac{1}{8}$ inch leading into an oppositely situated radial dimension of about 1/16 inch that joins the linear edge 23, said edge being a chord of about 9/32 inch, the arc described being about 21.5°. For the tab **20*a* of FIG. 2C the curvature of the radial flair can be about 1/32 inch. For the tab 20*b* of FIG. 2E, the height of edges 24*b* and 25*b* can be about 3/32 inch, with a chord 23*b*** of about 9/32. These dimensions can be considered as guidelines for obtaining a suitable $1\frac{1}{2}$ inch diameter closure in accordance with the present invention. However, it is readily understood that the closure of the present invention is suitable for containers of many sizes having openings that can vary in size. It is not intended that the disclosures herein be limited by the dimensions recited above, the scope of the invention being defined by the claims which follow.

I claim:

1. A child-resistant closure comprising:

(a) a can ring provided with an orifice through which the container is filled or emptied, the orifice having a peripheral rim having a downwardly extending flange, a minor portion of said flange extending below the lower edge of the major portion thereof, said minor portion being an unlocking tab, said can ring being further provided with indicia in its top surface to designate the location of said unlocking tab, and (b) a cap, the cap comprising:

(i) a disc portion;

(ii) an annular ring portion disposed in a plane parallel to said disc portion, said annular ring portion having a peripheral sealing skirt;

(iii) an annular wall connecting the disc portion and the annular ring portion;

(iv) a pull tab extending outwardly horizontally from the periphery of the annular ring portion;

(v) an annular retaining flange extending through the periphery of the disc portion; and (vi) a first protrusion extending outwardly horizontally from said annular retaining flange, the protrusion being proximate to and in alignment with the pull tab; the cap being adapted for snap fit retention within the can ring orifice, whereby the cap is removed from the orifice by rotating the cap such that the pull tab is in alignment with the indicia, the protrusion thereby being compressed and deflected downwardly by the unlocking tab, and applying a pull force to the pull tab.

2. The closure of claim 1 wherein the unlocking tab is canted inwardly towards the center of the orifice at an angle of less than about 12°.

3. The closure of claim 2 wherein said angle is between about 3° to 10°.

4. The closure of claim 1 wherein the unlocking tab has opposed arcuate portions leading away from the lower edge of said interior leg and a linear portion connecting said arcuate portions.

5. The closure of claim 1 wherein the unlocking tab is flaired below the lower edge of the interior leg.

6. The closure of claim 1 wherein the unlocking tab is essentially rectangular in configuration.

7. The closure of claim 1 wherein the cap further comprises one or more secondary protrusions extending outwardly horizontally from said annular retaining flange.

8. The closure of claim 7 wherein there are two secondary protrusions, each of which is positioned 90° from the first protrusion.

9. The closure of claim 1 wherein the pull force required to remove the cap from the orifice when the pull tab is in alignment with the indicia is from about 2 to about 8 pounds.

10. The closure of claim 9 wherein the rotating force to place the pull tab into alignment with the indicia is from about 2 to about 8 inch pounds.

11. The closure of claim 10 wherein the peripheral rim is in the form of an inverted U-shaped channel defined by an exterior leg and an interior leg, the interior leg being said downwardly extending flange, said unlocking tab describing an arc of from about 15° to 25° and wherein the cap is provided with an annular groove formed between said sealing skirt and said annular wall, on the underside of the annular ring portion, said annular groove adapted for flush superposition on the inverted U-shaped channel.

12. The closure of claim 11 wherein the pull force is between about 2 to 5 pounds.

13. The closure of claim 12 wherein the rotating force is between about 2 to 5 inch pounds.

14. The closure of claim 11 wherein the unlocking tab has opposed arcuate positions leading away from the lower edge of said interior leg and a linear portion thereinbetween.

15. The closure of claim 11 wherein the unlocking tab is flaired below the lower edge of the interior leg.

16. The closure of claim 11 wherein the unlocking tab is essentially rectangular.

17. The closure of claim 11 wherein the unlocking tab is canted inwardly towards the center of the orifice at an angle of 3° to 10° and wherein the arc described by the unlocking tab is from about 18° to 22°.

18. A container provided with the closure of claim 1.

19. A container provided with the closure of claim 11.

20. In a child-resistant closure having a can ring provided with an orifice through which the container is filled or emptied, said orifice having a peripheral rim having a downwardly extending flange, and a cap having a pull tab, an annular retaining flange adapted to reside beneath the edge of said downwardly extending flange, said retaining flange having a first protrusion extended outwardly horizontally therefrom, which protrusion is proximate to and in alignment with said pull tab, the improvement comprising an unlocking tab which is a minor portion of said downwardly extending flange extending below the lower edge of the major portion thereof and indicia provided on said can ring to designate the location of said unlocking tab.

21. A can ring comprising a planar surface having an orifice, said orifice having a peripheral rim having a downwardly extending flange, a minor portion of said flange extending below the lower edge of the major portion thereof, the minor portion being an unlocking tab, and indicia provided on the surface of said can ring to designate the location of the unlocking tab.

22. The can ring of claim 21 wherein the peripheral rim is in the form of an inverted U-shaped channel defined by an exterior leg and an interior leg, the interior leg being said downwardly extending flange.

23. The can ring of claim 22 further having an exterior peripheral rim in the form of an inverted U-shaped channel.

24. The can ring of claim 22 wherein the unlocking tab is canted inwardly towards the center of the orifice at an angle of less than about 12° and wherein the arc described by the unlocking tab is from about 15 to about 25°.

25. The can ring of claim 24 wherein said angle is between about 3° to 10° and wherein the arc described by the unlocking tab is from about 18° to about 22°.

26. The can ring of claim 24 wherein the unlocking tab has opposed arcuate portions leading away from the lower edge of said interior leg and a linear portion connecting said arcuate portions.

27. The can ring of claim 24 wherein the unlocking tab is flaired below the lower edge of the interior leg.

28. The can ring of claim 24 wherein the unlocking tab is essentially rectangular in configuration.

* * * * *